US012649180B2

(12) United States Patent
Su

(10) Patent No.: US 12,649,180 B2
(45) Date of Patent: Jun. 9, 2026

(54) METHOD FOR MANUFACTURING IRON GOLF CLUB HEAD

(71) Applicant: Chi-Hung Su, Tainan City (TW)

(72) Inventor: Chi-Hung Su, Tainan City (TW)

( * ) Notice: Subject to any disclaimer, the term of this patent is extended or adjusted under 35 U.S.C. 154(b) by 396 days.

(21) Appl. No.: 18/486,451

(22) Filed: Oct. 13, 2023

(65) Prior Publication Data

US 2025/0121428 A1 Apr. 17, 2025

(51) Int. Cl.
*B21K 17/00* (2006.01)
*A63B 53/04* (2015.01)

(52) U.S. Cl.
CPC ..... *B21K 17/00* (2013.01); *A63B 53/047* (2013.01); *A63B 53/0475* (2013.01); *A63B 2053/0491* (2013.01); *Y10T 29/49936* (2015.01)

(58) Field of Classification Search
CPC ..... A63B 53/0475; A63B 2053/0491; Y10T 29/49936; B21K 17/00
See application file for complete search history.

(56) References Cited

U.S. PATENT DOCUMENTS 5,230,509 A * 7/1993 Chavez ..... A63B 53/0487 473/336
6,422,950 B1 * 7/2002 Whitlam ..... A63B 53/02 473/340
2004/0058744 A1 * 3/2004 Solheim ..... A63B 53/0487 473/341
2005/0020377 A1 * 1/2005 Yang ..... A63B 60/00 473/335
2005/0049074 A1 * 3/2005 Chen ..... B23K 1/0008 473/337
2005/0143190 A1 * 6/2005 Takeda ..... A63B 53/047 473/349
2006/0172822 A1 * 8/2006 Liang ..... A63B 53/0466 473/350
2010/0009774 A1 * 1/2010 Chen ..... A63B 53/0475 473/350
2010/0331102 A1 * 12/2010 Golden ..... A63B 53/04 473/345
2013/0281227 A1 * 10/2013 Roach ..... A63B 69/0002 473/332
2013/0344988 A1 * 12/2013 Hettinger ..... A63B 60/00 72/352

(Continued)

FOREIGN PATENT DOCUMENTS

CN 213077403 U * 4/2021 ..... A63B 53/06
JP 2000176059 A * 6/2000 ..... A63B 53/04

(Continued)

*Primary Examiner* — Jermie E Cozart
(74) *Attorney, Agent, or Firm* — Rosenberg, Klein & Lee

(57) ABSTRACT

A method for manufacturing an iron golf club head has acts of providing a head body made of a metallic material, providing at least one weight insert made of a high-specific-gravity metallic material, forming engagement features at either the head body or the weight insert, and assembling and forging. Therefore, different metallic materials are integrally combined by forging to form the golf club head with a precise appearance. The head body and the weight insert are joined without gaps to enhance hitting performance and reduce noises upon striking. Flexibility of gravity center position is increased for achieving preferred requirements of lowing center of gravity and deepening the center of gravity.

9 Claims, 8 Drawing Sheets

(56) References Cited

U.S. PATENT DOCUMENTS

| | | | | |
|---|---|---|---|---|
| 2016/0008871 | A1* | 1/2016 | Su | B21K 25/00 29/428 |
| 2016/0184669 | A1* | 6/2016 | Deshmukh | C22C 19/03 473/335 |
| 2018/0050241 | A1* | 2/2018 | Su | A63B 53/047 |

FOREIGN PATENT DOCUMENTS

| | | | | |
|---|---|---|---|---|
| TW | I224519 B | * | 12/2004 | A63B 60/02 |
| WO | WO-2018005876 A2 | * | 1/2018 | A63B 53/0466 |

* cited by examiner

METHOD FOR MANUFACTURING IRON GOLF CLUB HEAD

BACKGROUND OF THE INVENTION

1. Field of the Invention

The present invention relates to a method for manufacturing a club head of a golf club, and more particularly to a method for manufacturing an iron golf club head.

2. Description of Related Art

In a conventional method for manufacturing an iron golf club head, a head body of a specific shape is mainly made by casting or forging metallic material. A mounting cavity is formed in a sole or a back of the head body, and a preformed weight insert is fixed in the mounting cavity of the head body by gluing or threaded engagement with gluing.

In the conventional method for manufacturing an iron golf club head, the weight insert fixed in the sole or the back of the head body has a higher specific gravity than the head body for lowering or increasing a depth of the center of gravity. However, because of assembly tolerance, gapping is formed between the weight insert and the mounting cavity of the head body. Although the weight insert is fixed in the mounting cavity of the head body by gluing or threaded engagement with gluing, the weight insert is not firmly combined to the head body and easily loosens or falls off. Hitting performance of the iron golf head is reduced and noises are generated upon striking. Moreover, it is difficult to achieve preferred requirements of lowing the center of gravity and deepening the center of gravity, because each weight insert with high specific gravity is fixed in the sole or the back of the head body.

To overcome the foregoing shortcomings of poor combination of the weight insert and the head body by gluing or threaded engagement with gluing, a method for manufacturing an iron golf club head has been provided. At least one inserting cavity is formed in the sole or the back of the head body by machining. Each of the at least one inserting cavity receives a respective weight insert. The head body with said weight insert is pressed by a forging process to make the head body tightly cover said weight insert to firmly combine the head body and said weight insert as a whole piece. Whereby, gap formed between the head body and said weight insert is reduced, and said weight insert is integrally and tightly combined with the head body. Bad combination between the weight insert and the head body due to gluing or threaded engagement with gluing can be improved.

In the foregoing method of combining the head body with the at least one weight insert as a whole piece by forging, the weight insert and the head body made of different metallic materials can be firmly combined. Hitting performance is enhanced, and noises upon striking are reduced. However, the foregoing method for manufacturing an iron golf club head can only lower the center of gravity or deepen center of gravity, but flexibility of gravity center position is limited. It is difficult to achieve preferred requirements of lowering the center of gravity and deepening the center of gravity.

To overcome the shortcomings, the present invention tends to provide a method for manufacturing an iron golf club head to mitigate or obviate the aforementioned problems.

SUMMARY OF THE INVENTION

The main objective of the invention is to provide a method for manufacturing an iron golf club head to solve the problems of bad combination between the weight insert and the head body and limited flexibility of gravity center position.

The method for manufacturing the iron golf head has acts of providing a head body made of a metallic material, providing at least one weight insert made of a high-specific-gravity metallic material, forming engagement features at either said head body or said weight insert, and assembling and forging.

In the act of providing a head body made of a metallic material, the head body includes a hitting face portion, a base portion located behind a lower part of the hitting face portion, and a hosel portion located at an end of the hitting face portion. The base portion includes a sole surface, a back surface, and at least one mounting cavity formed in a sole of the base portion and having a two-way opening extending from the sole surface to the back surface.

In the act of providing at least one weight insert made of a high-specific-gravity metallic material, a specific gravity of said high-specific-gravity metallic material is larger than 7.83 g/cc. Each of the at least one weight insert corresponds to a respective one of the at least one mounting cavity of the head body in shape and position.

In the act of forming engagement features at either said head body or said weight insert, wherein the engagement features are machined at inner faces of each of the at least one mounting cavity, facing distinct directions, or the engagement features are machined at exterior faces of each of the at least one weight insert, facing distinct directions of the respective mounting cavity.

In the act of assembling and forging, the at least one weight insert is placed into the at least one mounting cavity of the head body to form a blank of club head. The blank is formed to a club head in a specific shape by forging. Wherein said engagement features at the head body or the at least one weight insert are closely and tightly engaged with joining features formed at the at least one weight insert or the head body by forging to achieve an engagement without gaps therebetween and for tightly joining the at least one weight insert into the at least one mounting cavity without gaps. Each of the at least one weight insert has an external surface exposed from the two-way opening of the respective one of the at least one mounting cavity.

The method for manufacturing an iron golf club head in accordance with the present invention can achieve the following advantages.

1. Different metallic materials are integrally combined by forging to precisely form the shape of the golf club head.
2. The head body and the weight insert are joined without gapping to enhance hitting performance and reduce noises upon striking.
3. Flexibility of gravity center position is increased for achieving preferred requirements of lowering the center of gravity and deepening the center of gravity.

Other objects, advantages and novel features of the invention will become more apparent from the following detailed description when taken in conjunction with the accompanying drawings.

DETAILED DESCRIPTION OF PREFERRED EMBODIMENT

Figure 1:
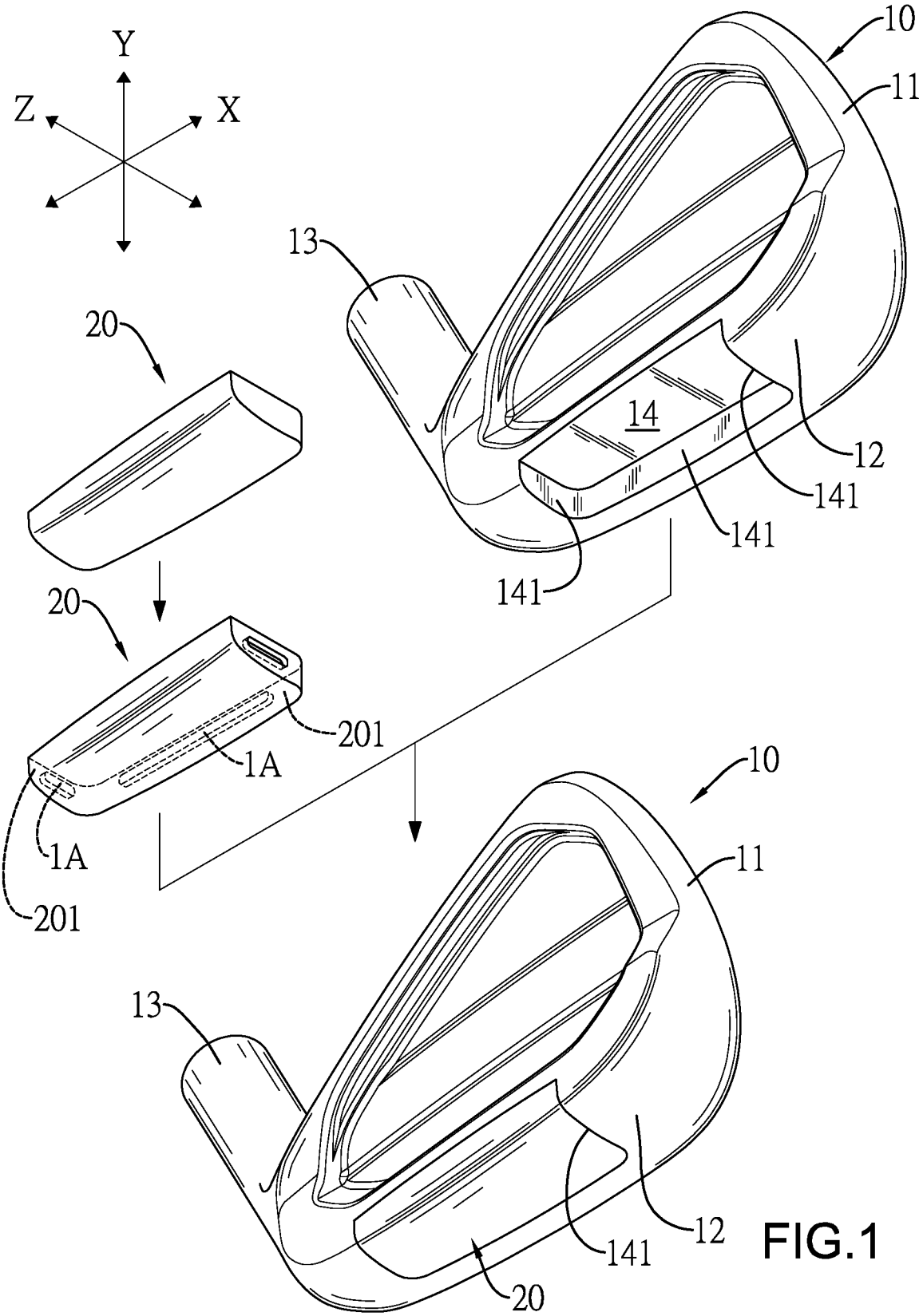
FIG. 1 shows an operational perspective view of acts of a method for manufacturing an iron golf club head in accordance with the present invention.
Figure 2:
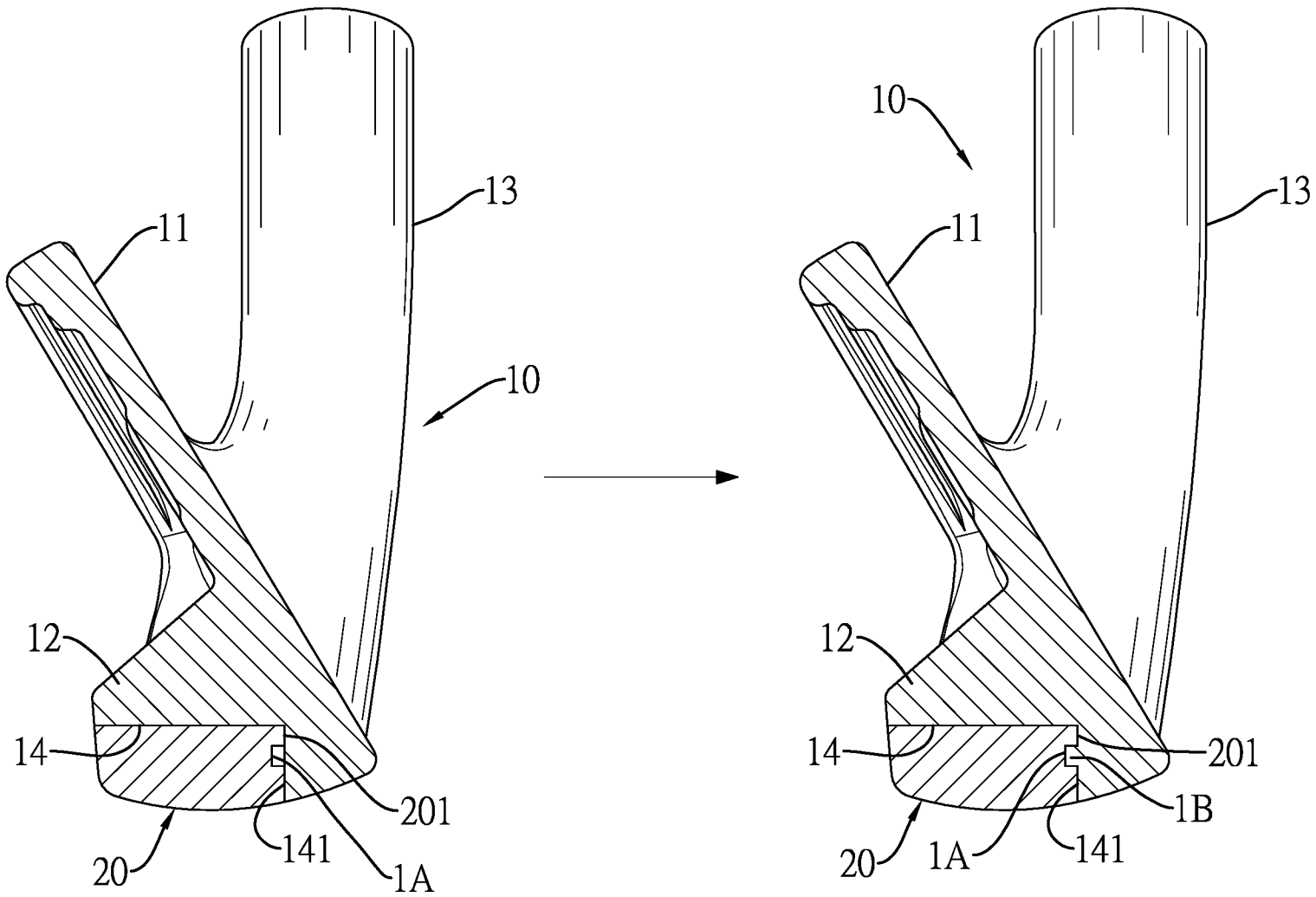
FIG. 2 shows an operational cross sectional side view of an embodiment of an act of assembling and forging.
Figure 3:
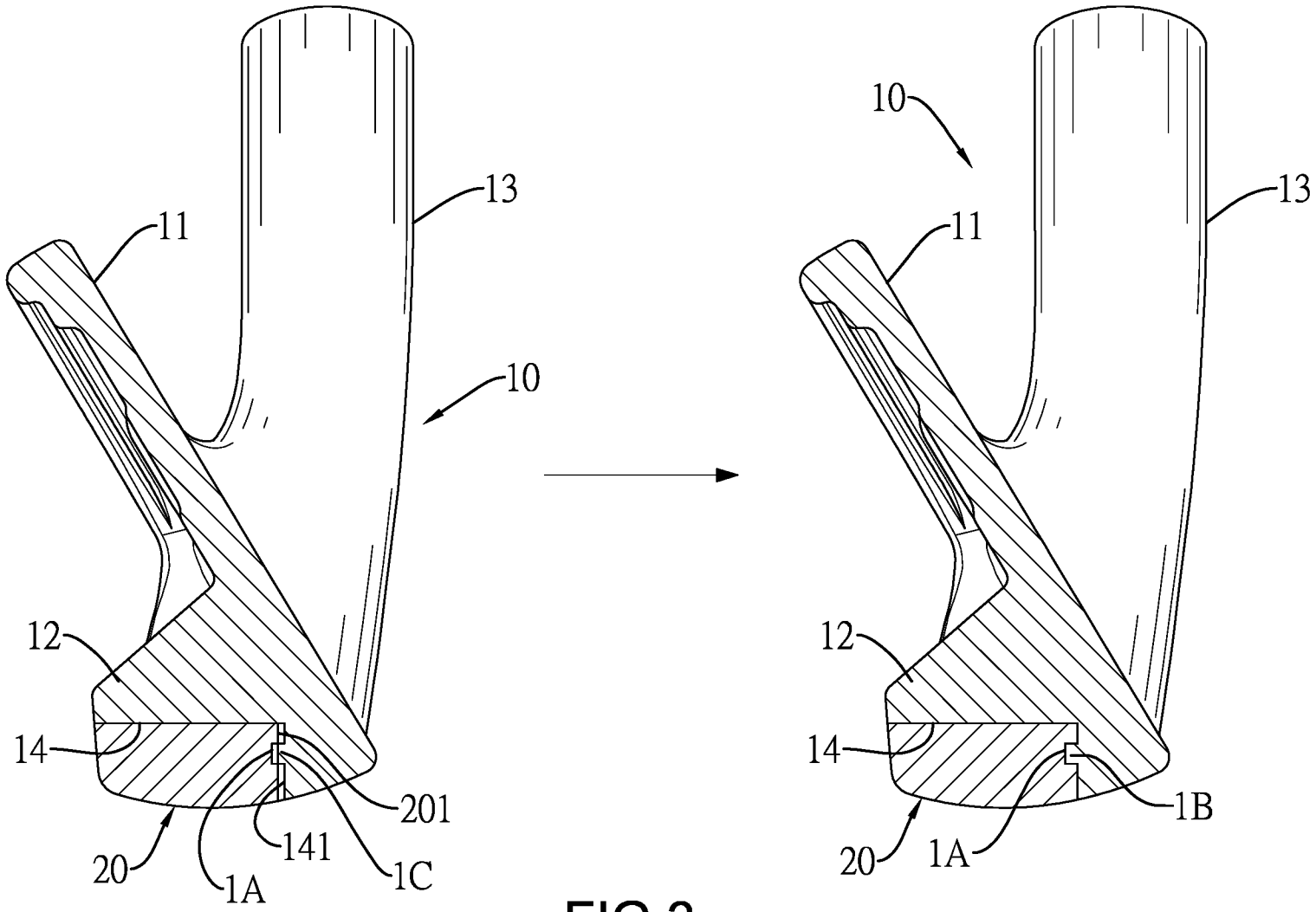
FIG. 3 shows an operational cross sectional side view of another embodiment of the act of assembling and forging.
Figure 4:
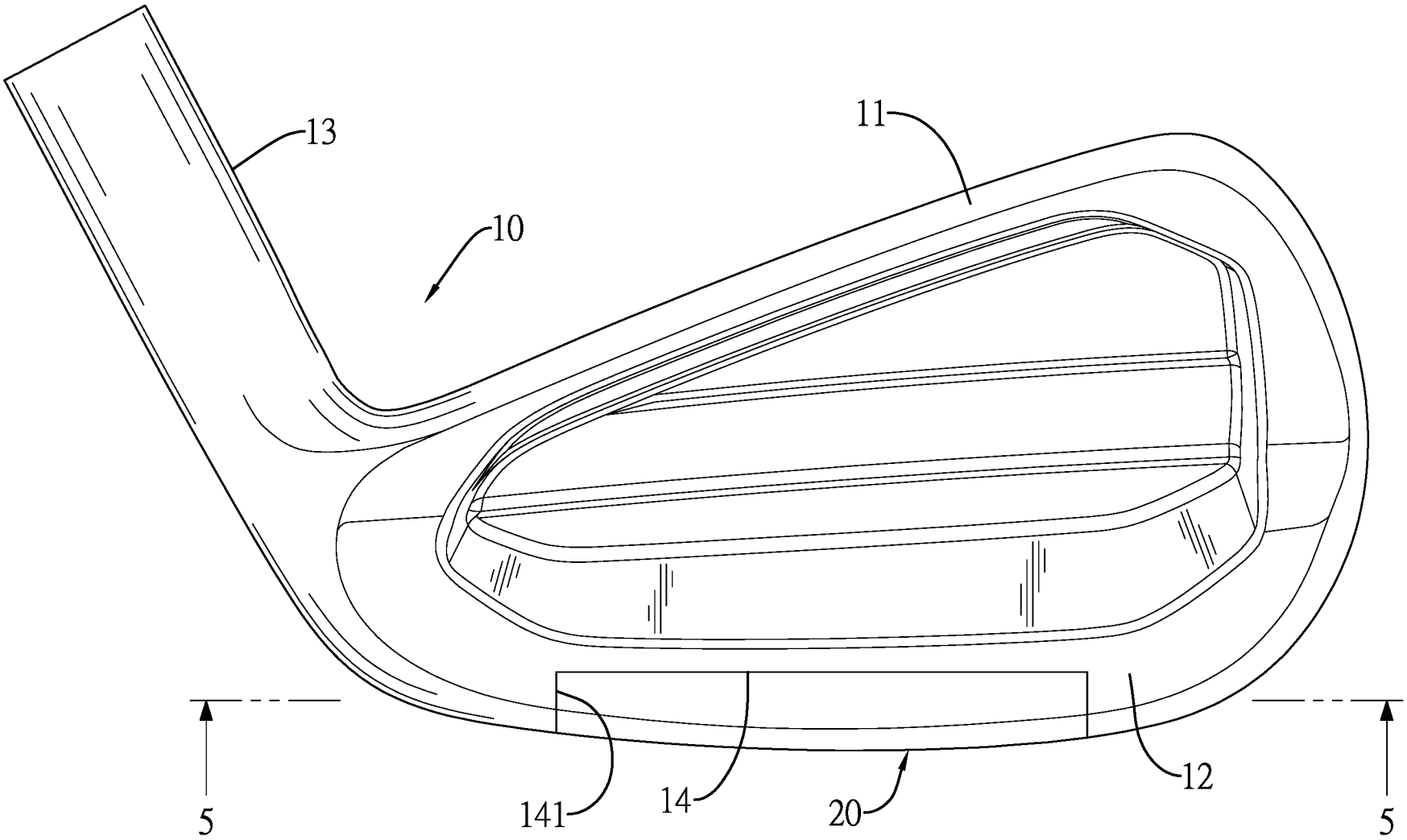
FIG. 4 shows a back side view of the act of assembling and forging.
Figure 5:
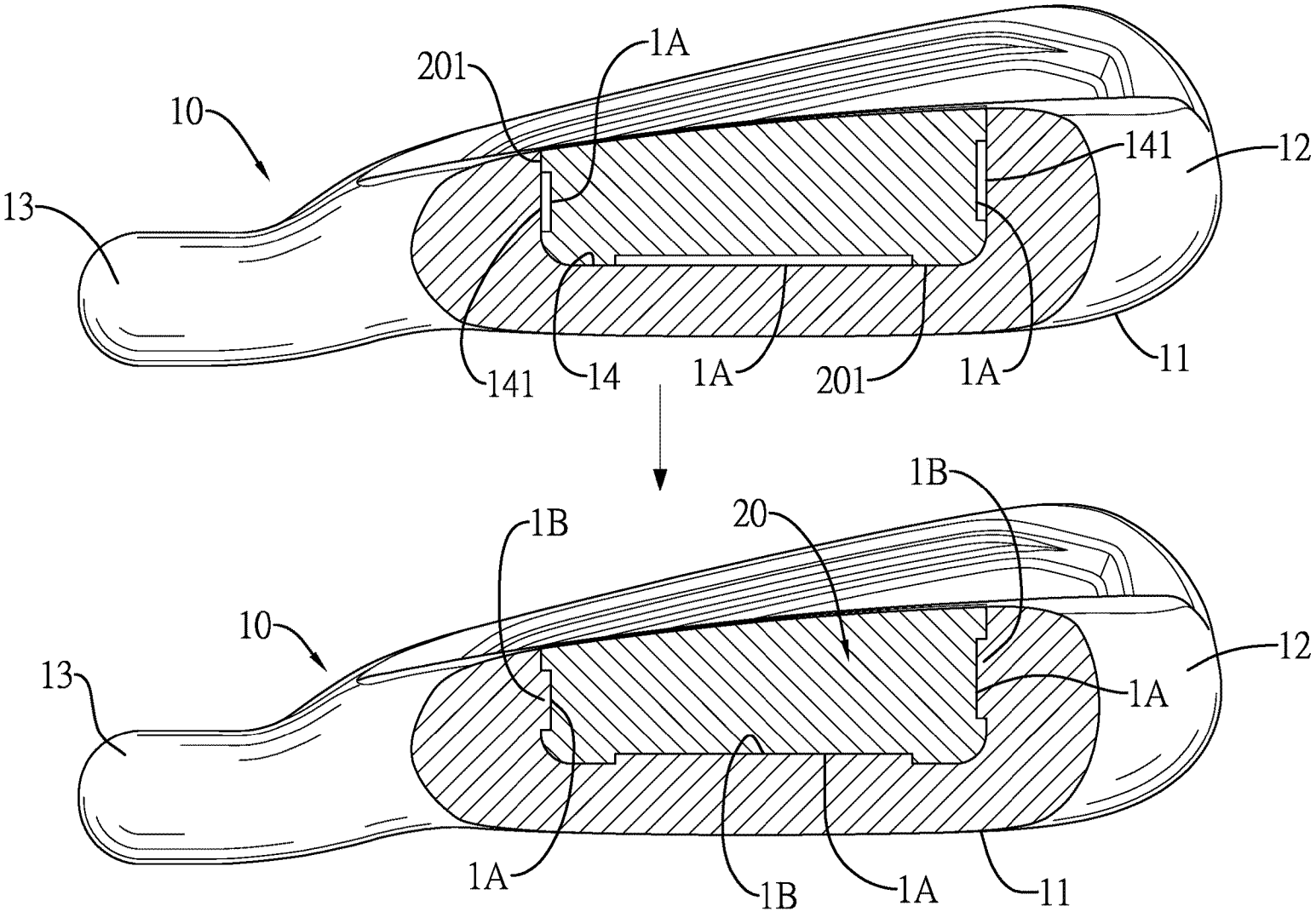
FIG. 5 shows an operational cross sectional view of the act of assembling and forging across line 5-5 in FIG. 4.

With reference to FIG. 1, a method for manufacturing an iron golf club head in accordance with the present invention is shown. Wherein, an X-axis direction (e.g. a left-to-right direction), a Y-axis direction (e.g. an up-to-down direction), and a Z-axis direction (e.g. a front-to-back direction) are perpendicular to one another in a three-dimensional space. The method comprises acts of providing a head body 10 made of a metallic material, providing at least one weight insert 20 preformed of a high-specific-gravity metallic material, forming engagement features 1A in either said head body 10 or said weight insert 20, and assembling and forging.

In the act of providing a head body 10 made of a metallic material, the head body 10 may be made by casting or forging. The head body 10 includes a hitting face portion 11, a base portion 12 located behind a lower part of the hitting face portion 11, and a hosel portion 13 located at an end of the hitting face portion 11 and extending upwardly. The hitting face portion 11 has a hitting face (front surface). The base portion 12 includes a sole surface at a sole thereof, a back surface at a back thereof, and at least one mounting cavity 14 formed in the sole of the base portion 12 and having a two-way opening extending from the sole surface to the back surface. The metallic material of the head body 10 may be selected from carbon steel and stainless steel. Said carbon steel can be selected from American Iron and Steel Institute and Society of Automotive Engineer (ASIS-SAE) numbers 1020C, 1025C, 1035C, 1045C, and 35CrMo according to carbon content or alloy composition. Said stainless steel may be selected from Japanese Industrial Standards (JIS) number SUS303, SUS304, SUS431, and 17-4 according to alloy compositions.

In the act of providing at least one weight insert 20 made of a high-specific-gravity metallic material, each of the at least one weight insert 20 corresponds to a respective one of the at least one mounting cavity 14 in shape and position. Said high-specific-gravity metallic material has a specific gravity larger than a specific gravity of the metallic material of the head body 10 and larger than 7.83 g/cc. In the embodiment, said high-specific-gravity metallic material has the specific gravity ranging from 8.0 g/cc to 18.2 g/cc, e.g. copper, tungsten-copper alloy, tungsten-nickel alloy, and tungsten steel.

In the act of forming engagement features 1A at either said head body or said weight insert 20, the engagement features 1A are machined at inner faces 141 of each of the at least one mounting cavity 14, facing distinct directions, or the engagement features 1A are machined at exterior faces 201 of each of the at least one weight insert 20, facing distinct directions of the respective mounting cavity 14. Each engagement feature 1A may be recessed or protruding.

In the act of assembling and forging, the at least one weight insert 20 is placed into the at least one mounting cavity 14 of the head body 10 to form a blank of club head. The blank is formed to a club head in a specific shape by forging. Said engagement features 1A at the head body 10 or at each weight insert 20 are closely and tightly engaged with joining features 1B formed at the at least one weight insert 20 or the head body 10 by forging. The inner faces of each mounting cavity 14 and exterior faces 201 of the respective weight insert 20 are tightly and closely joined without gaps accordingly. Each of the at least one weight insert 20 has an external surface exposed from the two-way opening of the at least one mounting cavity 14.

In the act of providing a head body 10 made of a metallic material, when the head body 10 is made by forging, the head body 10 is forged by a single-pass forging process or a multi-pass forging process. In the single-pass forging process, a crude rod made of a metallic material is forged once (rough forging process) to form the head body 10 in a specific shape. In the multi-pass forging process, the crude rod made of a metallic material is forged twice (a rough forging process and a fine forging process) or more than twice (a rough forging process, a fine forging process, and a final forging process) to form the head body precisely of the desired weight, specification and appearance.

Figure 7:
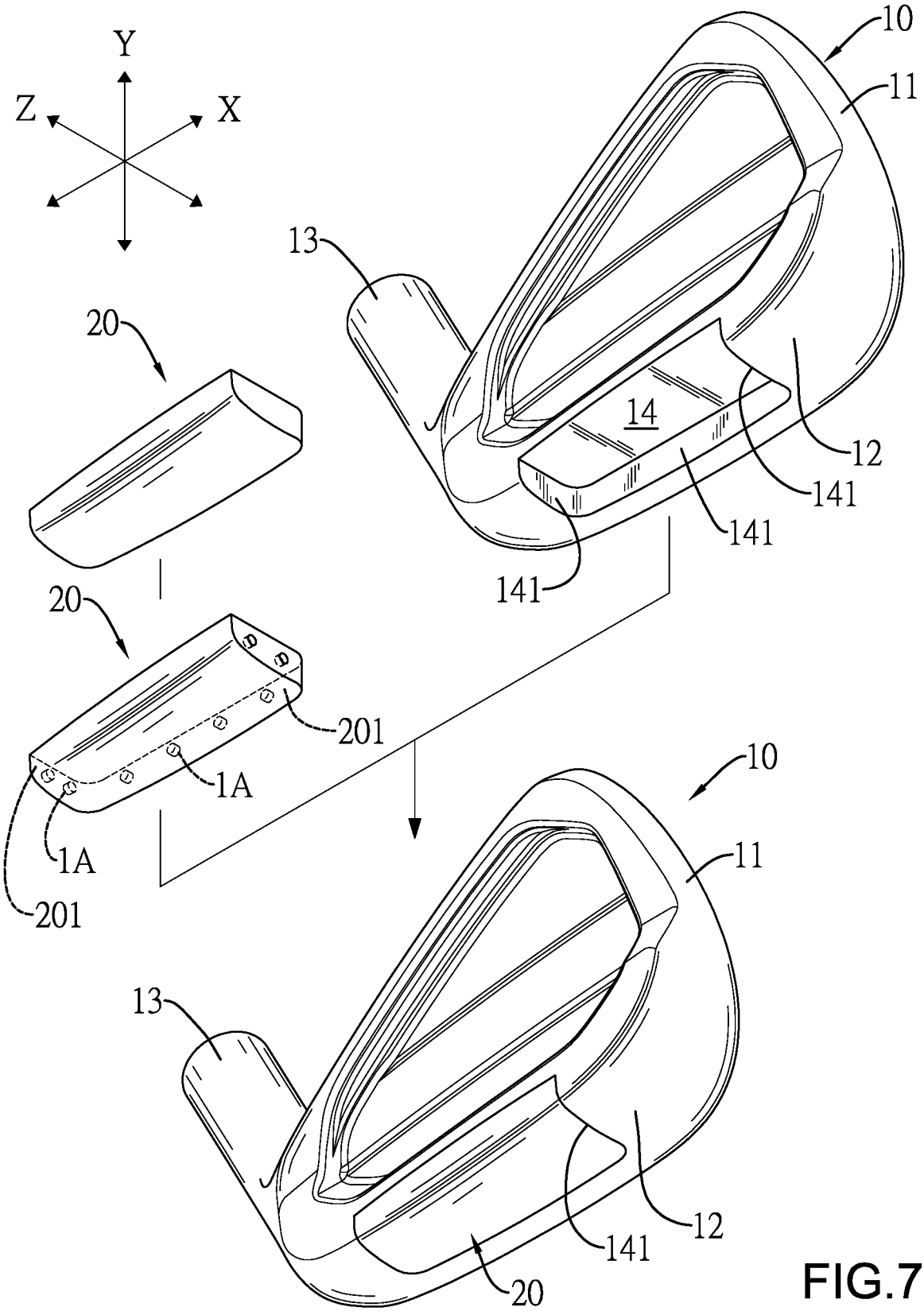
FIG. 7 shows another operational perspective view of acts of a method for manufacturing an iron golf club head in accordance with the present invention.
Figure 8:
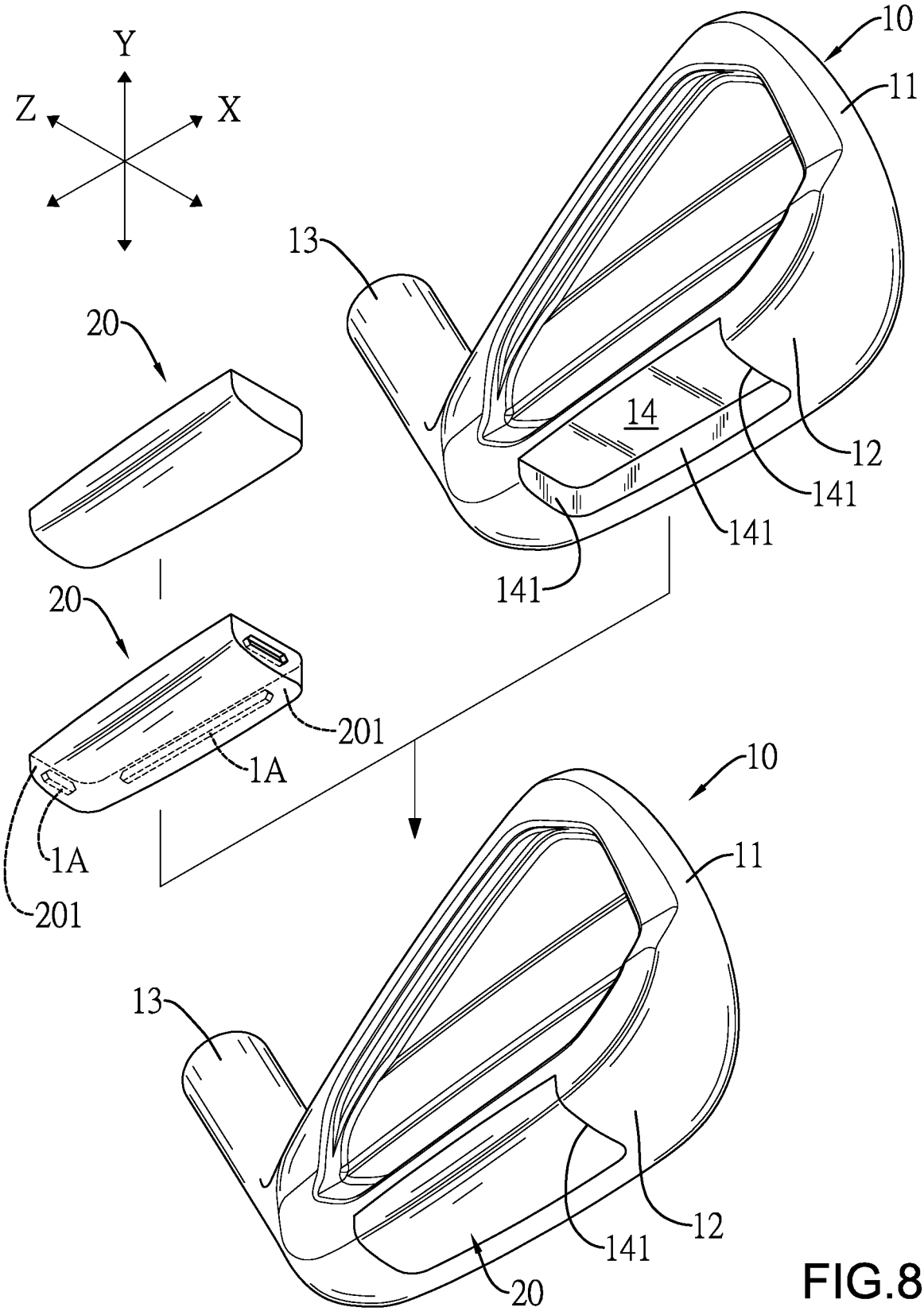
FIG. 8 shows another operational perspective view of acts of a method for manufacturing an iron golf club head in accordance with the present invention.

With reference to FIGS. 1 to 5, in the act of forming engagement features 1A in either said head body 10 or said weight insert 20, the engagement features 1A are recessed in and formed at the exterior faces 201 of the weight insert 20 facing distinct directions. As shown in FIGS. 1, 7 and 8, the engagement features 1A may be elongated recesses, round recesses, triangular recesses, polygonal recesses, or recesses in other geometric shapes. With reference to FIGS. 1 to 5, the inner faces 141 of the mounting cavity 14 of the head body 10 may be flat or have protrusions 1C corresponding to the engagement features 1A on the weight insert 20 in shape and position. In the act of assembling and forging, said joining features 1B formed by forging process, are formed at the inner faces 141 of each of the at least one mounting cavity 14 of the head body 10, and are tightly and closely embedded into said engagement features 1A, respectively, for tightly joining the at least one weight insert 20 into the at least one mounting cavity 14 without gaps.

In the act of assembling and forging, a forging temperature of forging depends on the metallic materials of the head body 10 and the weight insert 20. In the embodiment, the metallic material of the head body 10 may be selected from carbon steel and stainless steel, and the high-specific-gravity metallic material of the weight insert 20 may be selected from copper, tungsten-copper alloy, tungsten-nickel alloy, and tungsten steel, so the forging temperature May range from 800° C. to 1100° C.

Figure 6:
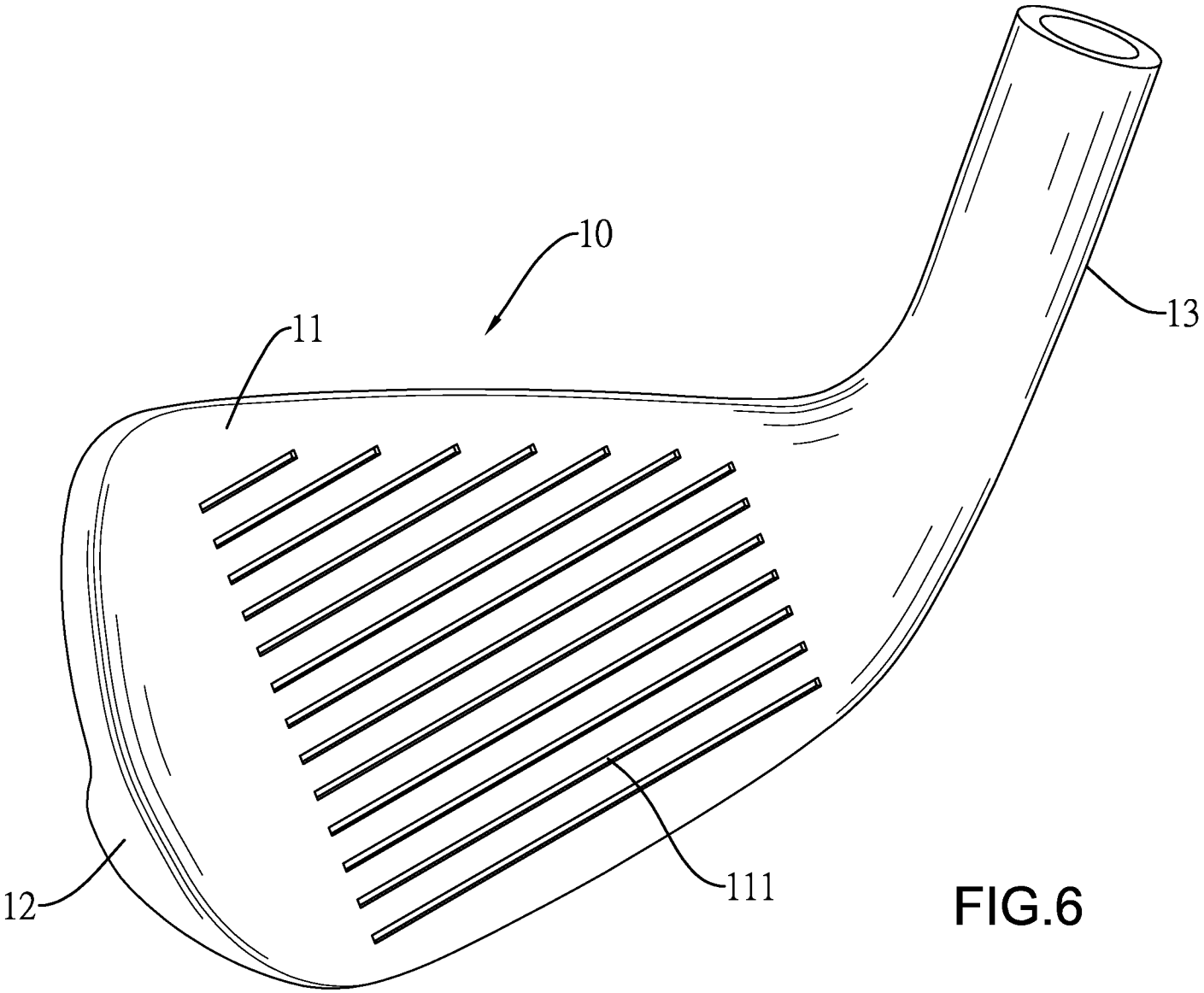
FIG. 6 is a perspective view of an act of forming multiple grooves in a front surface of the hitting face portion of the head body by machining.

With reference to FIG. 6, after the act of assembling and forging, the method of the present invention may further comprise an act of forming multiple grooves 111 in the front surface of the hitting face portion 11 of the head body 10 by machining and an act of surface finishing to remove raw edges at external surfaces of the head body 10 and the weight insert 20.

In the method for manufacturing the iron golf club head in accordance with the present invention, the head body 10 and the weight insert 20 are made of different metallic materials, the engagement features 1A are formed to either the head body 10 or the weight insert 20 by machining, the head body 10 and the weight insert 20 made of different metallic materials are assembled as a blank of club head and then the blank is forged to integrally form a golf club head in a specific shape. Combining different metallic materials to a single piece by a forging process, the shape of the golf club head can be precisely formed. In addition, the engagement features 1A at one of the head body 10 and the weight insert 20 are tightly and closely engaged with the joining features 1B, formed by forging, at the other one of the head body 10 and the weight insert 20 to combine the head body 10 and the weight insert 20. So the weight insert 20 can be closely and tightly joined in the mounting cavity 14 of the head body 10 without gaps. The weight insert 20 and the head body 10 are integrally and tightly combined with each other as a single piece. Hitting performance can be enhanced and noises upon striking can be reduced.

In addition, the two-way opening of the mounting cavity 14 of the head body 10 extends from the sole surface to the back surface, so the weight insert embedded in the head body 10 is exposed from the sole surface to the back surface of the head body 10, so the weight insert 20 can provide counterweight performance from the sole to the back of the head body 10, thereby increasing flexibility in gravity center of position for achieving preferred requirements of low center of gravity and deep center of gravity.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for manufacturing an iron golf club head, the method comprising acts of:

providing a head body made of a metallic material, wherein the head body includes a hitting face portion, a base portion located behind a lower part of the hitting face portion, and a hosel portion located at an end of the hitting face portion; the base portion includes a sole surface, a back surface, and at least one mounting cavity formed in a sole of the base portion and having a two-way opening extending from the sole surface to the back surface;

providing at least one weight insert made of a high-specific-gravity metallic material, wherein a specific gravity of said high-specific-gravity metallic material is larger than 7.83 g/cc, wherein each of the at least one weight insert corresponds to a respective one of the at least one mounting cavity of the head body in shape and position;

forming engagement features at either said head body or said weight insert, wherein the engagement features are machined at inner faces of each of the at least one mounting cavity, facing distinct directions, or the engagement features are machined at exterior faces of each of the at least one weight insert, facing distinct directions of the respective one of the at least one mounting cavity; and assembling and forging, wherein the at least one weight insert is placed into the at least one mounting cavity of the head body to form a blank; the blank is formed to a club head in a specific shape by forging, wherein said engagement features at the head body or at the at least one weight insert are closely and tightly engaged with joining features formed at the at least one weight insert or the head body by forging without gaps between the engagement features and the joining features and for tightly joining the at least one weight insert into the at least one mounting cavity without gaps; each of the at least one weight insert has an external surface exposed from the two-way opening of the respective one of the at least one mounting cavity; wherein in the act of forming engagement features at either said head body or said weight insert, the engagement features are recessed in the exterior faces of each of the at least one weight insert facing to distinct directions; the inner faces of the respective one of the at least one mounting cavity facing to the engagement features are flat; and in the act of assembling and forging, said joining features are formed at the inner faces of the at least one mounting cavity by forging, and are tightly and closely embedded into said engagement features formed at the at least one weight insert for tightly joining the at least one weight insert into the at least one mounting cavity respectively without gaps.

2. The method as claimed in claim 1, wherein the engagement features are elongated recesses, round recesses, or polygonal recesses.

3. The method as claimed in claim 1, wherein the specific gravity of said high-specific-gravity metallic material ranges from 8.0 g/cc to 18.2 g/cc.

4. The method as claimed in claim 1, wherein in the act of providing a head body made of a metallic material, the head body is forged by a single-pass forging process or a multi-pass forging process.

5. The method as claimed in claim 1, wherein the method comprises an act of forming multiple grooves in a front surface of the hitting face portion of the head body by machining after the act of assembling and forging.

6. A method for manufacturing an iron golf club head, the method comprising acts of:

providing a head body made of a metallic material, wherein the head body includes a hitting face portion, a base portion located behind a lower part of the hitting face portion, and a hosel portion located at an end of the hitting face portion; the base portion includes a sole surface, a back surface, and at least one mounting cavity formed in a sole of the base portion and having a two-way opening extending from the sole surface to the back surface;

providing at least one weight insert made of a high-specific-gravity metallic material, wherein a specific gravity of said high-specific-gravity metallic material is larger than 7.83 g/cc, wherein each of the at least one weight insert corresponds to a respective one of the at least one mounting cavity of the head body in shape and position;

forming engagement features at either said head body or said weight insert, wherein the engagement features are machined at inner faces of each of the at least one mounting cavity, facing distinct directions, or the engagement features are machined at exterior faces of each of the at least one weight insert, facing distinct directions of the respective one of the at least one mounting cavity; and assembling and forging, wherein the at least one weight insert is placed into the at least one mounting cavity of the head body to form a blank; the blank is formed to a club head in a specific shape by forging, wherein said engagement features at the head body or at the at least one weight insert are closely and tightly engaged with joining features formed at the at least one weight insert or the head body by forging without gaps between the engagement features and the joining features and for tightly joining the at least one weight insert into the at least one mounting cavity without gaps; each of the at least one weight insert has an external surface exposed from the two-way opening of the respective one of the at least one mounting cavity; wherein in the act of forming engagement features at either said head body or said weight insert, the engagement features are recessed in the exterior faces of the at least one weight insert facing to distinct directions; the head body has multiple protrusions protruding from the inner faces of the at least one mounting cavity, facing to the engagement features and respectively corresponding to the engagement features being recessed in shape; and in the act of assembling and forging, said joining features are formed at the inner faces of the at least one mounting cavity by forging, and are tightly and closely embedded into said engagement features formed at the at least one weight insert for tightly joining the at least one weight insert into the at least one mounting cavity respectively without gaps.

7. The method as claimed in claim 6, wherein the engagement features are elongated recesses, round recesses, or polygonal recesses.

8. The method as claimed in claim 6, wherein the specific gravity of said high-specific-gravity metallic material ranges from 8.0 g/cc to 18.2 g/cc.

9. The method as claimed in claim 6, wherein in the act of providing a head body made of a metallic material, the head body is forged by a single-pass forging process or a multi-pass forging process.

* * * * *